US010215507B2

(12) United States Patent
Mastroianni et al.

(10) Patent No.: US 10,215,507 B2
(45) Date of Patent: Feb. 26, 2019

(54) COIL SUPPORT PAD HAVING CONDENSATE DRAINAGE FUNCTIONALITY

(71) Applicant: TRANE INTERNATIONAL INC., Piscataway, NJ (US)

(72) Inventors: Scott A. Mastroianni, Atlanta, GA (US); Chris Menhennett, Lynn Haven, FL (US)

(73) Assignee: TRANE INTERNATIONAL INC., Davidson, NC (US)

( * ) Notice: Subject to any disclaimer, the term of this patent is extended or adjusted under 35 U.S.C. 154(b) by 192 days.

(21) Appl. No.: 14/687,572

(22) Filed: Apr. 15, 2015

(65) Prior Publication Data

US 2015/0292816 A1 Oct. 15, 2015

Related U.S. Application Data

(60) Provisional application No. 61/979,767, filed on Apr. 15, 2014.

(51) Int. Cl.

| | |
|---|---|
| ***F28F 9/013*** | (2006.01) |
| ***F28F 9/00*** | (2006.01) |
| ***F28F 17/00*** | (2006.01) |
| ***F28D 1/047*** | (2006.01) |
| ***F24F 1/36*** | (2011.01) |
| *F28D 21/00* | (2006.01) |

(52) U.S. Cl.

CPC ..... *F28F 9/013* (2013.01); *F24F 1/36* (2013.01); *F28D 1/047* (2013.01); *F28F 9/001* (2013.01); *F28F 17/005* (2013.01); *F28D 2021/0068* (2013.01)

(58) Field of Classification Search

CPC ..... F24F 1/22; F24F 1/36; F25B 13/00; F28D 1/047; F28D 2021/0068; F28F 17/005; F28F 9/001; F28F 9/013

See application file for complete search history.

(56) References Cited

U.S. PATENT DOCUMENTS

| | | | | | |
|---|---|---|---|---|---|
| 3,904,158 | A * | 9/1975 | Michael | F16M 5/00 | 248/149 |
| 4,471,633 | A * | 9/1984 | Tinsler | F25D 23/006 | 62/277 |
| 4,748,827 | A * | 6/1988 | Chang | F28F 9/013 | 62/272 |
| 4,748,828 | A * | 6/1988 | Chang | F24F 1/36 | 62/272 |
| 4,876,778 | A * | 10/1989 | Hagihara | B21D 53/085 | 29/428 |
| 5,535,819 | A * | 7/1996 | Matsuura | F28F 9/001 | 165/149 |
| 5,931,220 | A * | 8/1999 | Ueda | B60K 11/04 | 165/149 |
| 7,108,049 | B2 * | 9/2006 | Makino | F28D 1/0435 | 165/140 |

(Continued)

*Primary Examiner* — Filip Zec

(74) *Attorney, Agent, or Firm* — Hamre, Schumann, Mueller & Larson, P.C.

(57) ABSTRACT

The embodiments described herein are directed to a coil support pad for condensate drainage and a method of manufacturing the coil support pad. The coil support pad generally functions to provide support for outdoor coils and facilitate the drainage of condensate away from the coils.

19 Claims, 7 Drawing Sheets

(56) References Cited

U.S. PATENT DOCUMENTS

| | | | | |
|---|---|---|---|---|
| 7,117,926 | B2 * | 10/2006 | Mori | B62D 25/084 165/67 |
| 7,284,388 | B2 * | 10/2007 | Yoshida | B60H 1/3233 62/285 |
| 7,418,826 | B2 * | 9/2008 | Rios | F24F 13/222 62/285 |
| 7,708,052 | B2 * | 5/2010 | Leman | F24F 1/36 165/78 |
| 9,395,034 | B1 * | 7/2016 | Rowland | F24F 13/32 |
| 2014/0131024 | A1 * | 5/2014 | Iwazaki | F24F 13/222 165/185 |

* cited by examiner

COIL SUPPORT PAD HAVING CONDENSATE DRAINAGE FUNCTIONALITY

FIELD

The embodiments disclosed herein relate generally to a component within a unit of an air conditioning system or unit and/or HVAC unit or system and in particular, a component that supports an outdoor coil and has condensate drainage functionality.

BACKGROUND

In typical outdoor units of an air conditioning system, plastic injected coil support pads are installed to support an outdoor coil. The pads are generally designed to sit on top of embossments in the base pan. Some pads are secured in place by a machine screw, with a clearance hole on a tab on the side of the pad, and an engagement hole in the base pan. Other pads are not screwed into place, and simply rely on the compressive force of the coil to stay in place. Additional plastic pads can be added along the length of the coil to minimize coil deformation during transportation and installation. For these additional pads for which there are no corresponding embosses in the base pan or engagement hole for a screw, an adhesive-backed foam block is used to keep the pad in place. The adhesive side of the pad is affixed to the base pan, and the plastic pad sits on top of the foam block.

SUMMARY

The embodiments described herein are directed to a coil support pad for condensate drainage and a method of manufacturing the coil support pad. The coil support pad generally functions to provide support for outdoor coils and facilitates the drainage of condensate away from the coils.

In general, the coil support can be used in a unit within an air conditioning system, e.g., an outdoor unit. In some examples, the outdoor unit can include a case, a condenser, a fan, an outdoor coil, and a coil support pad.

In some examples, the case can include a front plate, a rear plate, a lateral plate, a top cover and a bottom pan.

In some examples, the outdoor coil can be a microchannel coil that may include a plurality of microchannel tubes with one or more microchannels therein. In some examples, a refrigerant flows through the microchannels. In some examples, the microchannel tubes generally extend from one or more headers. In some examples, the headers generally extend vertically and are horizontally spaced apart from each other for example by a predetermined distance. In some examples, the microchannels or the headers may be in fluid communication with each other and with the overall air-conditioning system.

In some embodiments, the coil support pad can be incorporated as part of the outdoor unit by being installed onto the base pan prior to the outdoor coil installation. In general, the coil support pad has one or more mating features that mate, for example, with one or more corresponding mating features on the base pan, facilitate in securing the outdoor coil on the coil support pad and/or directs liquid such as condensate and rain water away from the coils, thereby preventing the coils from being submerged in the liquid.

In some embodiments, the coil support pad is shaped so that the coil support pad as viewed in top view generally follows the outline of the outdoor coil. In some examples, the coil support pad is substantially continuous. The term "substantially continuous" means that the coil support pad is a single integrated unit so that there are no spaces that would separate the coils support pad into multiple units. In some examples, the coil support provides substantially continuous support for the outdoor coil. The term "substantially continuous support" means that the coil support pad is configured so that when the outdoor coil is provided on the coil support pad, a pressure applied on the coil support pad is evenly distributed across the coil support pad so as to reduce and/or eliminate point loads on the coil support pad.

In one embodiment, the coil support pad includes a base having a central portion, a first arm portion and a second arm portion. In some examples, the first arm portion extends outwardly along a first axis from a first end of the central portion and the second arm portion extends outwardly along a second axis from a second end of the central portion. In some examples, the first and second axes are substantially perpendicular to one another.

In some examples, the base has top and bottom principal surfaces. In some examples, the bottom principal surface includes a mating feature. In some examples, the mating feature is an emboss feature or a deboss feature. The bottom principal surface further includes slotted features. The slotted features are configured to allow debris, condensation, rain water, etc. to escape from an outdoor section of the outdoor unit.

In some examples, the top principal surface is sloped relative to a vertex. In some examples, the top principal surface is patterned with a plurality of support protrusions. In some instances, the sloped surface and/or the plurality of support protrusions are configured to provide continuous support and/or facilitate the drainage of liquid, for example, condensate, away from the outdoor coils.

In some examples, the top principal surface has one or more support features. In some examples, the support feature is generally configured to position the outdoor coil during installation and/or facilitate in securing the outdoor coil during assembly of the outdoor unit.

In some examples, the support feature protrudes upwardly from the top principal surface. In some examples, the support feature has a shape as viewed in top view that generally follows an outline of a cross-section of a coil header as viewed in side view. In some examples, the support feature is U-shaped as viewed in top view.

In some examples, during assembly, gasketing is applied to the top of the outdoor coil before the top cover is installed. Once the top cover is installed, a compressive force maintains substantially continuous support for the outdoor coil along the length of the outdoor coil.

In one embodiment, the disclosed method of manufacturing the outdoor unit involves assembling the coil support pad on the base pan by mating the mating features on the coil support with the corresponding mating features on the base pan, securing the outdoor coil on the coil support pad by securing the outdoor coil to the support feature of the coil support pad, applying a gasket on a top of the outdoor coil, and installing the top cover on the outdoor coil so that a compressive force maintains substantially continuous support for the outdoor coil along the length of the outdoor coil.

BRIEF DESCRIPTION OF THE DRAWINGS

Referring now to the drawings in which like reference numbers represent corresponding parts throughout.

DETAILED DESCRIPTION

The embodiments described herein are directed to a coil support pad for condensate drainage and a method of manufacturing the coil support pad. In some examples, the coil support pad is included in a unit, for example, an outdoor unit of an air conditioning system. In some examples, the outdoor unit can be used on a stationary or mobile structure.

In general, the coil support pad generally is configured to provide support for outdoor coils and facilitate the drainage of condensate away from the outdoor coils.

Figure 1:
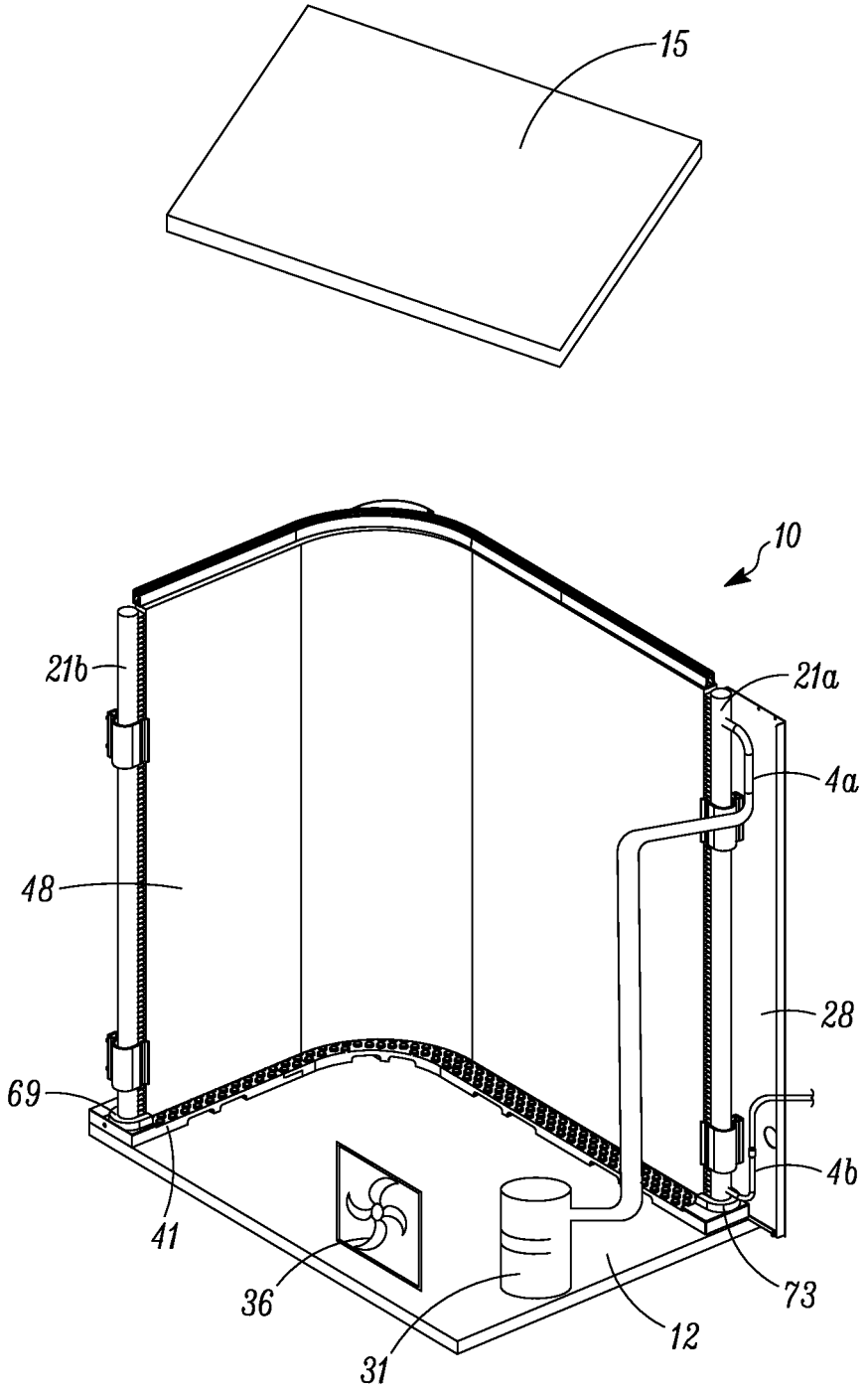
FIG. 1 is a perspective view illustrating a portion of an outdoor unit of an air conditioning system, according to one embodiment.
Figure 2:
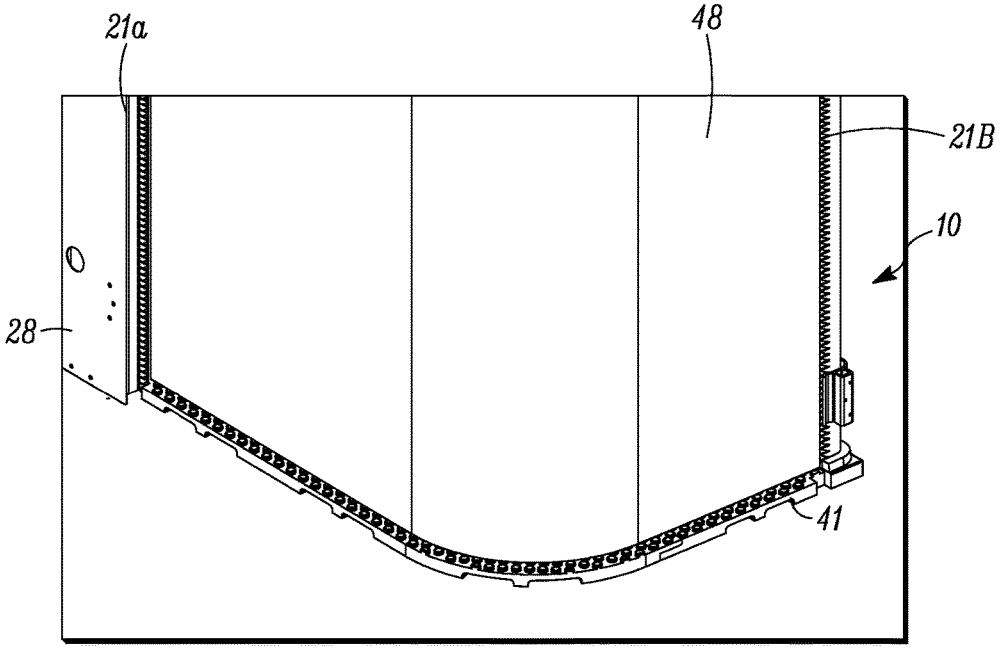
FIG. 2 is a perspective view of a portion of an outdoor coil and a coil support pad shown in FIG. 1, according to one embodiment.
Figure 3:
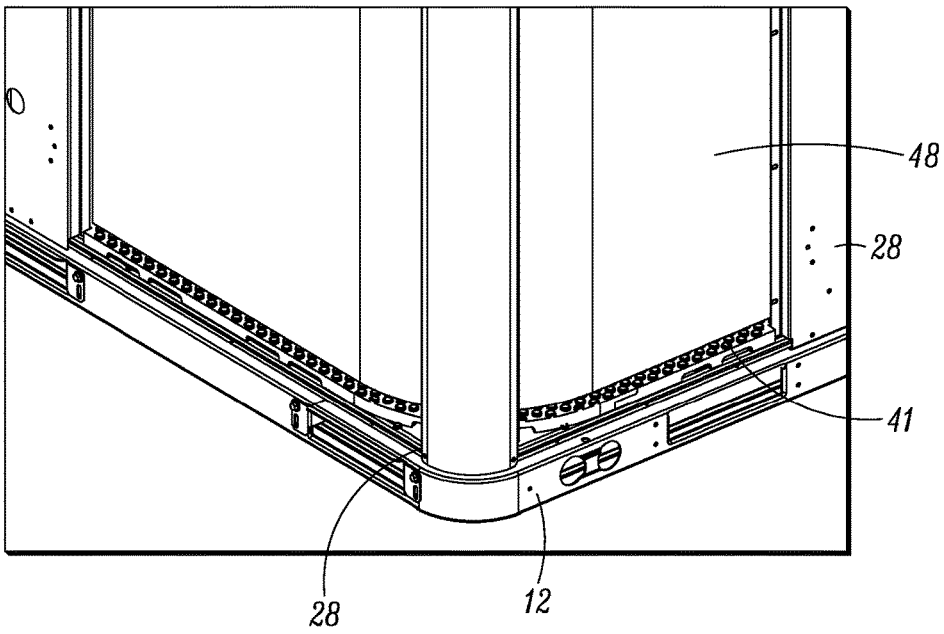
FIG. 3 is a perspective view of a portion of an outdoor coil, a coil support pad and a base pan shown in FIG. 1, according to one embodiment.

FIGS. 1-3 show one example of a portion of an outdoor unit 10 in which the disclosed coil support can be utilized. The outdoor unit 10 includes a compressor 31, a fan 36, a bottom pan 12, a top cover 15, a lateral plate 28, an outdoor coil 48 and a coil support pad 41. The outdoor unit 10 can further include front, side and back plates (not shown) along with the top cover 15 and the lateral plate 28 to form a case.

In general, the compressor 31 is suitable for compressing a refrigerant. The compression of the refrigerant results in refrigerant being heated. The heated refrigerant then is sent through the condenser coil 48 via an inlet 4*a* where the heat is dissipated. The fan 36 generally functions to discharge air that is passed through the outdoor coil 48. The compressor 31 utilized can be any type of compressor suitable for use in an air conditioning system. In some examples, the unit 10 can include an evaporator (not shown). In this instance, a lower pressure line (not shown) can receive refrigerant from the evaporator, which passes to the compressor 31.

In some examples, the outdoor coil 48 can be a microchannel coil that may include a plurality of microchannel tubes with one or more microchannels therein. In some examples, a refrigerant enters through the inlet 4*a*, flows across the microchannels, and flows out through an outlet 4*b*. In some examples, the microchannel tubes generally extend from a first header 21*a* to a second header 21*b*. In some examples, the headers 21*a*, 21*b* generally extend vertically and are horizontally spaced apart from each other. In some examples, the headers 21*a*, 21*b* may be in communication with the overall air-conditioning system via the inlet 4*a* and the outlet 4*b*.

In some embodiments, the outdoor unit 10 is assembled such that the coil support pad 41 is provided on the base pan 12, the outdoor coil 48 is provided on the coil support pad 41, and the top cover 15 is provided on the outdoor coil 48.

Details of the outdoor coil 48 will now be discussed with reference to FIGS. 4-6. The coil support pad 41 is shaped so that the coil support pad 41 as viewed in top view generally follows the outline of the outdoor coil 48. In the example shown in the figures, the coil support pad 41 as viewed in top view generally resembles a boomerang-like shape. In particular, the coil support pad 41 includes a base 50 having a central portion 54, a first arm portion 62 and a second arm portion 59. In one embodiment, the central portion 54 is a curved portion and has a first end 72 and a second end 75. The first arm portion 62 extends outwardly along a first axis A-A from the first end 72 of the central portion 54 and the second arm portion 59 extends outwardly along a second axis B-B from the second end 75 of the central portion 54, where the first axis A-A and the second axis B-B form a relative angle $\alpha$. In the example shown, the relative angle $\alpha$ between the first and second axes is about 90 degrees. However, it is to be realized that the relative angle $\alpha$ can be any angle that is suitable for the outdoor coil 48 to be provided on the coil support pad 41 and for the coil support pad 41 to suitably follow the outline of the outdoor coil 48. Moreover, it is to be realized that the outdoor coil 48 can have any shape that is suitable for use in an outdoor unit, for example, a straight line as viewed in top view.

Figure 4:
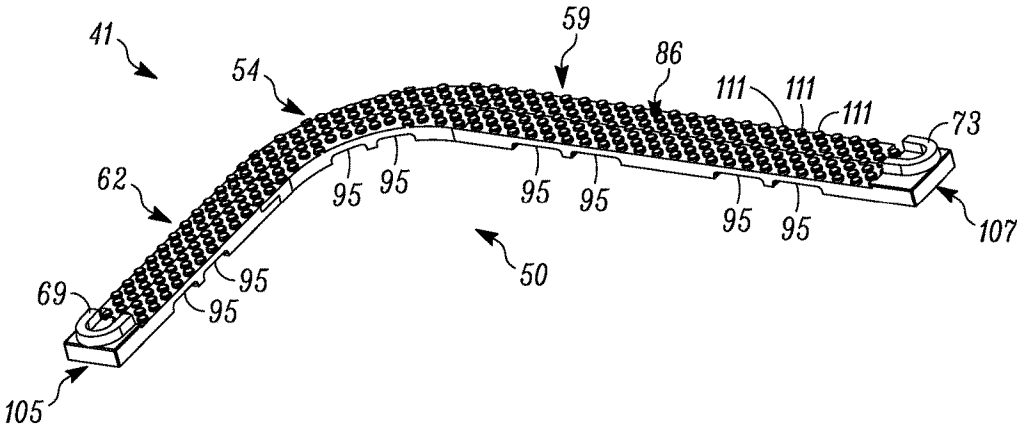
FIG. 4 is a perspective view of a coil support pad shown in FIG. 1, according to one embodiment.
Figure 5:
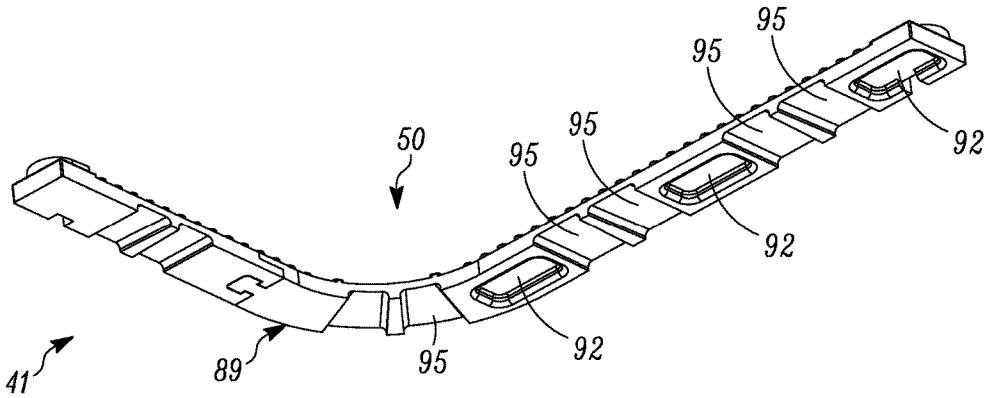
FIG. 5 is a bottom view of a coil support pad shown in FIG. 1, according to one embodiment.
Figure 6:
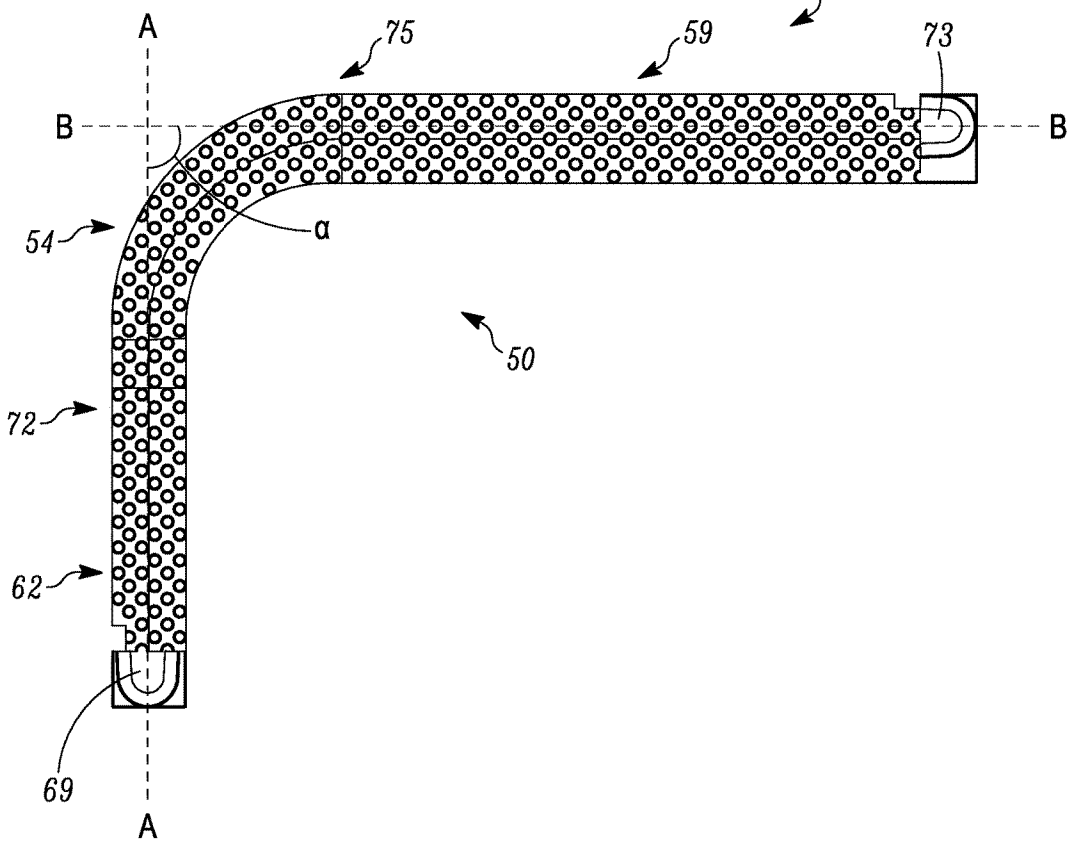
FIG. 6 is a top view of a coil support pad shown in FIG. 1, according to one embodiment.

Referring to FIGS. 4 and 5, the base 50 has a top principal surface 86 and a bottom principal surface 89. The bottom principal surface includes mating features 92. In the example shown in FIG. 5, the mating features are deboss features 92. The deboss features 92 generally are configured to mate with corresponding emboss features on the surface of the bottom pan 12 so as to secure the coil support pad 41 to the bottom pan 12.

In the example illustrated, the coil support pad 41 includes three mating features 92 which are shown to be deboss features. However, it is to be appreciated that any number and/or any type of mating feature that is suitable for attaching the coil support pad 41 to the bottom pan 12 can be utilized. For instance, the coil support pad 41 can include one or more emboss features, while the bottom pan 12 can include one or more corresponding deboss features.

The bottom principal surface 89 further includes slotted features 95. The slotted features 95 are openings that are configured to allow debris, condensation, rain water, etc. to escape from an outdoor section of the outdoor unit 10.

Referring to FIGS. 1 and 4, the coil support pad 41 has a first terminal end 105 on the first arm portion 62 and a second terminal end 107 on the second arm portion 59. A first support feature 69 is provided on the top principal surface 86 of the first terminal end 105, and a second support feature 73 is provided on the top principal surface 86 on the second terminal end 107. The support features 69, 73 are generally configured to position the outdoor coil 48 during assembly of the outdoor unit 10 and/or facilitate in securing the outdoor coil 48 during assembly of the outdoor unit 10.

Figure 7:
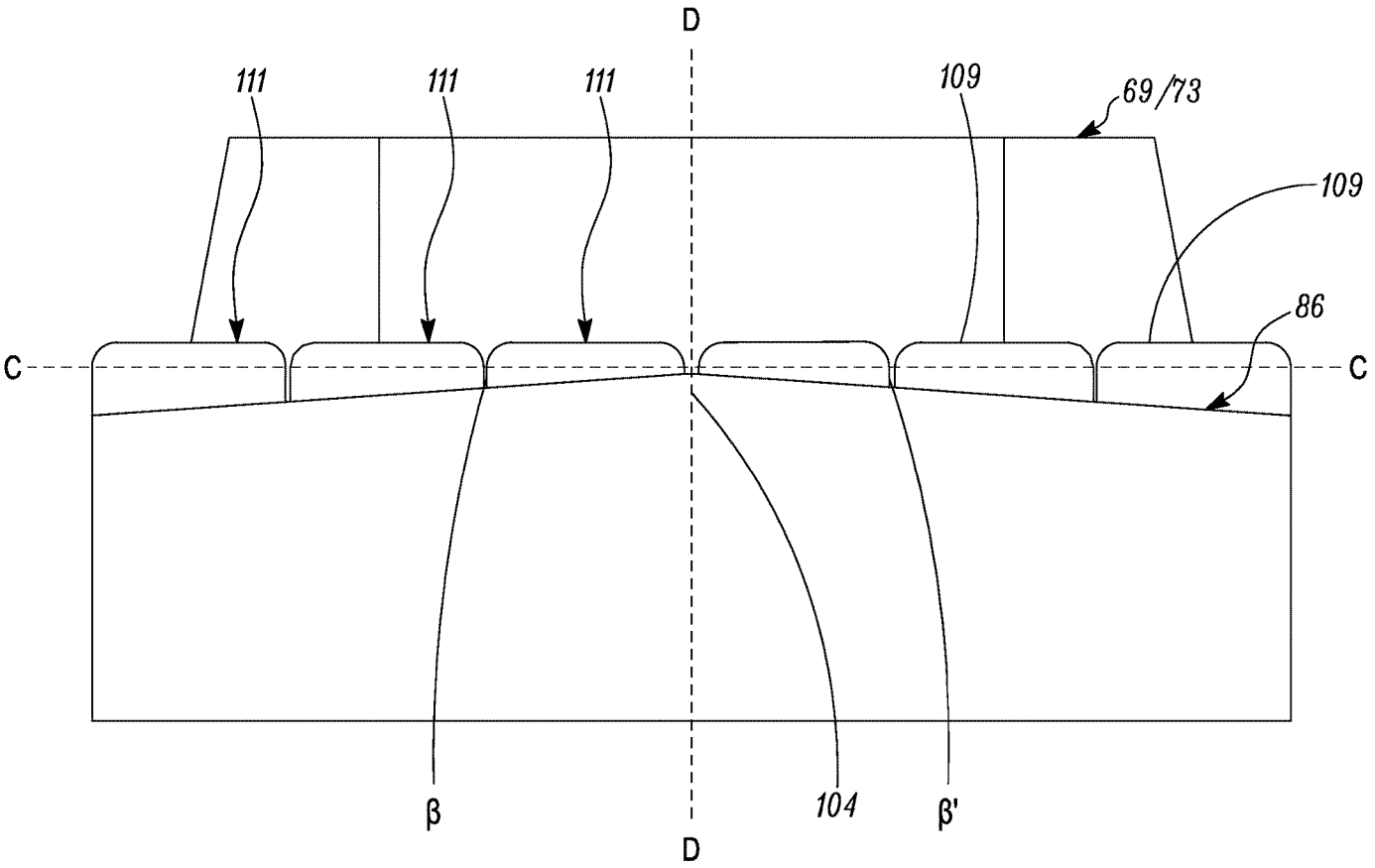
FIG. 7 is a cross-sectional view of a coil support pad shown in FIG. 1, according to one embodiment.

Referring to FIGS. 4 and 7, the support features 69, 73 protrude upwardly in the direction of a vertical axis D-D from the top principal surface 86. Each of the support features 69, 73 has a shape as viewed in top view that generally follows a portion of an outline of a cross-section of the coil headers 21*a*, 21*b*. In the example illustrated, each of the support features 69, 73 is U-shaped as viewed in top view. The support features 69, 73 are generally configured to localize and/or facilitate in securing the outdoor coil 10 during assembly by hooking the coil headers 21*a*, 21*b* as illustrated in FIG. 1.

Referring again to FIGS. 4 and 7, the top principal surface 86 is sloped relative to a central vertex 104 at angles $\beta$ and $\beta'$ relative to a horizontal axis C-C that passes through the vertex 104 and is perpendicular to the vertex axis D-D. In some examples, the angles β and β' are angles sufficient to facilitate the drainage of liquid, for example, condensate, away from the outdoor coils 48. In some instance, the angles β and β' can be about 2 to about 30 degrees. In the illustrated figures, β and β' are shown to be about the same angles as one another, but they can be different from one another, depending on the design of the coil support pad 41 based on needs, for example, more drainage of condensate on one side than the other.

In some examples, the coil support pad 41 can be patterned with a plurality of support protrusions 111 that protrude upwardly along a vertical axis D-D from the top principal surface 86. In some examples, the support protrusions 111 are generally configured to provide substantially continuous support for the outdoor coil 48 and/or facilitate drainage of liquid away from the outdoor coils 148 due to spaces between the support protrusions 111 which create drainage paths for condensate liquid, etc. to pass, for instance, together with the sloped features of the top principal surface 86. In some examples, the distance that the support protrusions 111 protrude from the top principal surface 86 is less than the distance that the support features 69, 73 protrude from the top principal surface 86.

In some examples, the pattern of the support protrusions 111 is uniform. The term "uniform" means that each of the support protrusions 111 has a shape and/or dimension that is substantially the same as one another and/or the number of support protrusions 111 and the relative positions of the support protrusions 111 are the same within a given area. In some examples, some or all of the support protrusions 111 can have a shape and/or dimension that is different from one another.

In some examples, the support protrusions 111 substantially cover a surface area of the top principal surface 86. In some examples, the support protrusions 111 substantially cover a surface area of the top principal surface 86 such that about 50% to about 90% of the surface area of the top principal surface 86 is covered with the support protrusions 111.

In some examples, each of the support protrusions 111 is substantially cylindrical in shape. In this instance, each of the support protrusions 111 has a top surface 109 that is substantially flat and is circular as viewed in top view. In some examples, each of the support protrusions 111 protrudes a distance so that the top surface 109 of each of the support protrusions 111 is substantially level on a plane that is parallel to the horizontal axis C-C.

In some examples, the shape of each of the support protrusions 111, the number of support protrusions 111 and the pattern of the support protrusions 111 can be any shape, any number and any pattern, respectively, that is suitable for facilitating the drainage of liquid, for example, condensate, away from the outdoor coils 48.

In some examples, the coil support pad 41 is substantially continuous. The term "substantially continuous" means that the coil support pad 41 is a single integrated unit so that there are no spaces that would separate the coils support pad 41 into multiple units.

Figure 8:
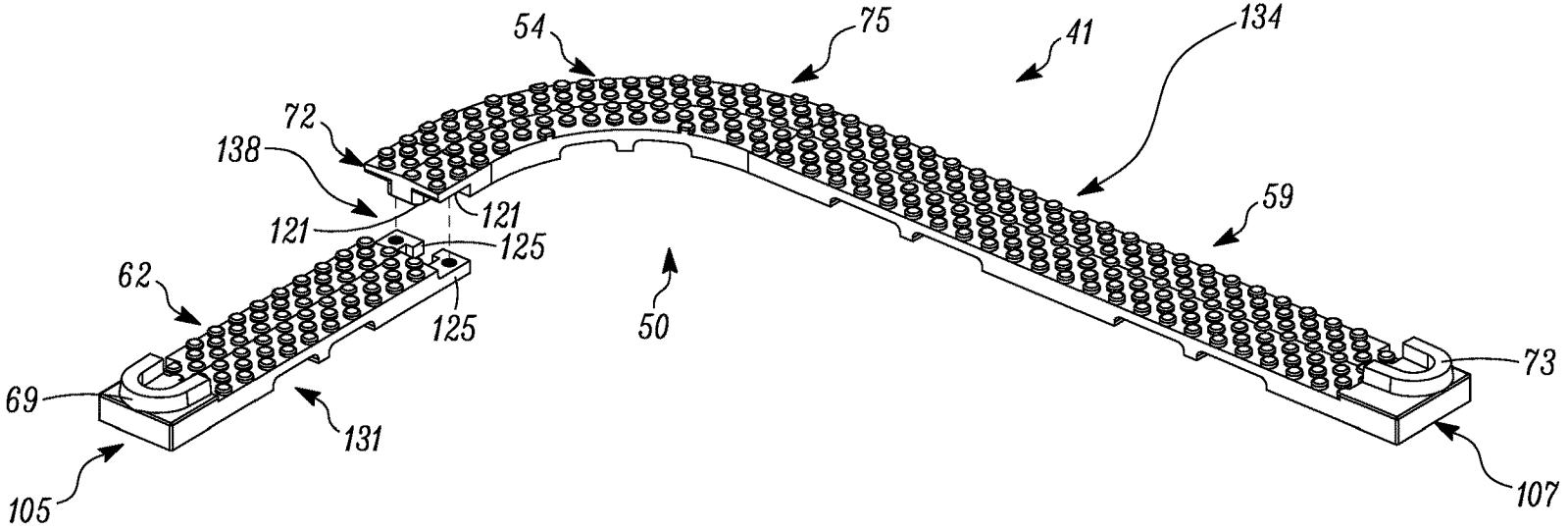
FIG. 8 is a perspective view of a coil support pad shown in FIG. 1, according to one embodiment.

In some instances, the coil support pad 41 is modular, and can be made of more than one unit as illustrated in FIG. 8. In the example shown in FIG. 8, the first arm portion 62 can be a modular unit 131 and the central portion 54 and the second arm portion 59 can be another modular unit 134. The modular unit 131 can have a mating feature 125 on an end 138 that is opposite to the terminal end 105, and the modular unit 134 can have a mating feature 121 on the end 72 that mates with the mating feature 125. The mating features 121, 125 can have a lock-and-key structure. In the example shown in FIG. 8, the mating feature 121 includes protrusions, and the mating feature 125 includes corresponding pockets for the protrusions. It is to be realized, however, that any suitable mating feature may be utilized. The coil support pad 41 can be assembled by mating the mating features 121, 125 so that the coil support pad 41 is substantially continuous. In this instance, the assembled coil support pad 41 forms a single integrated unit so that there are no spaces that would separate the modular units 131, 134.

The material of the coil support pad 41 can be any material that is suitable for supporting an outdoor coil and/or preventing metal-to-metal corrosion of the aluminum coil, and/or has absorptive properties that help protect the outdoor coil, for example, during transportation and installation. In some examples, the material is Styrofoam, expanded polypropylene and the like, etc. In some examples, the coil support pad 41 is a molded expanded polypropylene.

Figure 9:
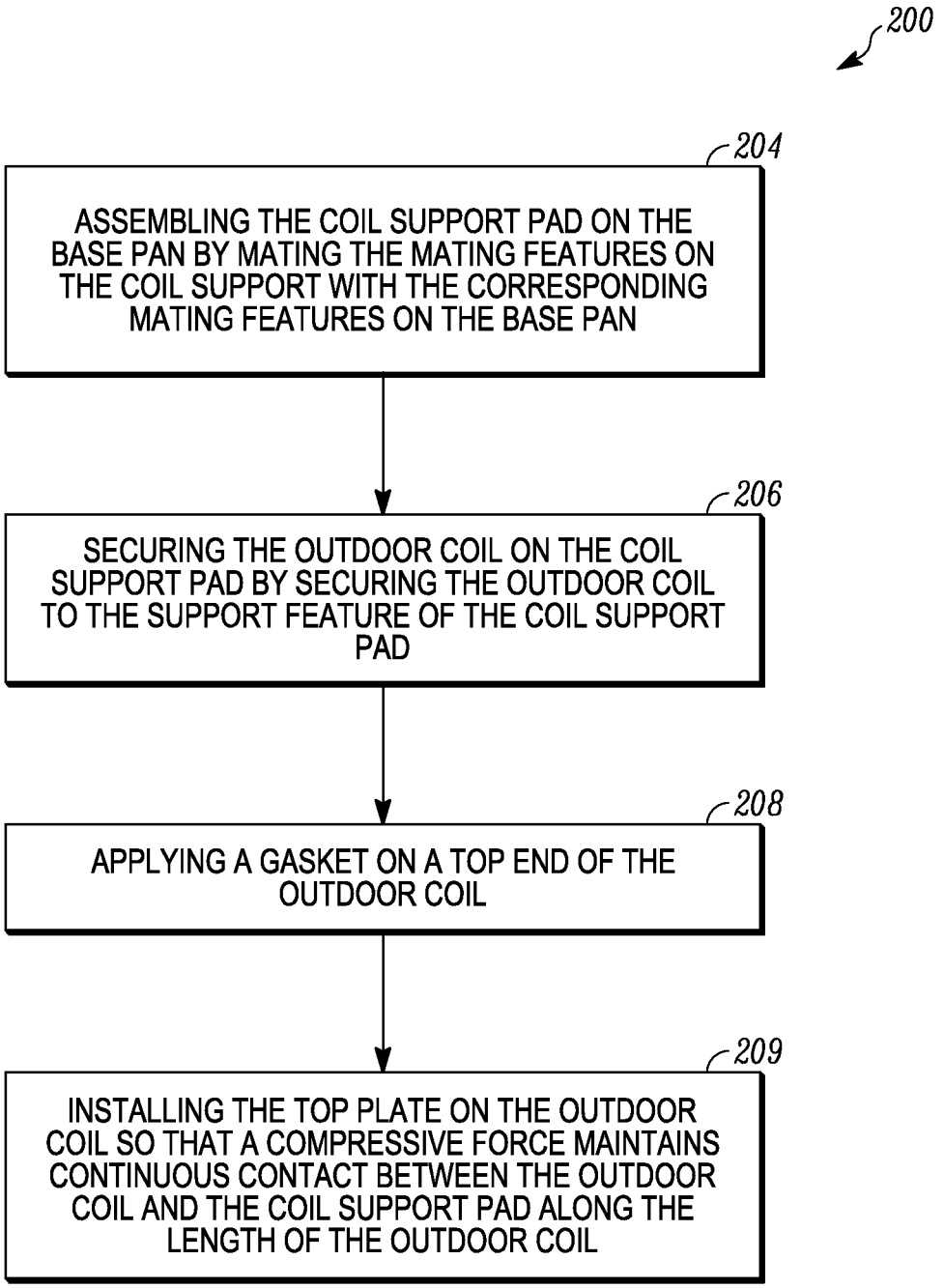
FIG. 9 illustrates a flow chart of a method of manufacturing an outdoor unit, according to one embodiment.

Referring to FIG. 9, in one embodiment, a method 200 of manufacturing the outdoor unit 10 involves assembling the coil support pad 41 on the base pan 12 by mating the mating features 92 on the coil support pad 41 with the corresponding mating features on the base pan 12 (204), securing the outdoor coil 48 on the coil support pad 41 by securing the outdoor coil 48 to the support features 69, 73 of the coil support pad 41 (206), applying a gasket on a top end of the outdoor coil 48 (208), and installing the top cover 15 on the outdoor coil 48 so that a compressive force maintains continuous support between the outdoor coil 48 and the coil support pad 41 along the length of the outdoor coil 48 (209).

Advantageously, the disclosed coil support pad does not rely on the use of "teeth", e.g., that are made of plastic, for supporting the outdoor coil. That is, conventional pads have "teeth" that extend above the flat surface on which the coil sits. The teeth often create point loads and cause coil damage both internally during coil install and externally during shipping and/or installation. Instead, the disclosed coil support pad utilizes a compressive force of the top cover to secure the outdoor coil in place. Additionally, the "U" shaped support feature helps hold the coil in place once installed by fixing the coil's header location. During outdoor coil installation, the coil support pad provides a larger surface area on which to install the coil with a manipulator so as to provide substantially continuous support for the coil, for example, via the support protrusions. Once the coil is on the pad, the operator can easily adjust the coil position into place.

Moreover, since the coil support pad can be a continuous piece, the risk of the support popping off of the bottom pan can be eliminated. In some examples, the debosses on the pads are press-fit onto the embossments of the bottom pan, securing the pad in place. Once the coil is installed, and even more so when the top cover is installed, there is a very minimal chance, if at all, that the pad can become dislodged. This makes the overall outdoor coil assembly less susceptible to imperfections in coil flatness, bend angle accuracy, and up-line dead tube deformation. This also can decrease the risk of galvanic corrosion of the coil by eliminating the risk of the pad becoming dislodged and the coil coming into contact with the other metal, e.g., the bottom pan.

Even further, in some examples, the continuous outdoor coil support pad can eliminate or at least reduce point loads on the outdoor coil. In this instance, the bottom of the coil is supported along the entire length of the coil, including around the coil bend (which laboratory testing has proven to be a particularly susceptible area or the most susceptible area for coil deformation).

ASPECTS

Any of aspects 1-17 can be combined with one another.

Aspect 1

A coil support pad for use in an outdoor unit that includes
a bottom pan and an outdoor coil, comprising
a base including
a central portion having a first end and a second end,
a first arm portion that extends outwardly in the direction of a first axis from the first end of the central portion,
a second arm portion that extends outwardly in the direction of a second axis from the second end of the central portion, the first and second axes forming a relative angle $\alpha$,
a top principal surface having a vertex and is sloped relative to the vertex, the principal surface being patterned with a plurality of support protrusions, and the top principal surface having one or more support features that protrudes upwardly from the top principal surface, and
a bottom principal surface having a mating feature.

Aspect 2

The coil support pad of aspect 1, wherein the central portion is a curved portion.

Aspect 3

The coil support pad of aspect 1, wherein the first and second axes are on the same plane and perpendicular to one another.

Aspect 4

The coil support pad of aspect 1, wherein the coil support pad is substantially continuous.

Aspect 5

The coil support pad of aspect 1, wherein the one or more support features are configured to localize and/or secure the outdoor coil.

Aspect 6

The coil support pad of aspect 1, wherein the one or more support features is U-shaped as viewed in top view.

Aspect 7

The coil support pad of aspect 1, wherein the mating feature of the bottom principal surface is configured to mate with a corresponding mating feature on a bottom pan.

Aspect 8

The coil support pad of aspect 1, wherein the bottom principal surface further comprises a slotted feature that is configured to allow debris and/or liquid to pass through.

Aspect 9

The coil support pad of aspect 1, wherein the top principal surface is sloped at an angle of between about 3 to about 30 degrees relative to a horizontal axis that passes through the vertex.

Aspect 10

The coil support pad of aspect 1, wherein each of the support protrusions has a cylindrical shape and is substantially circular as viewed in top view.

Aspect 11

The coil support pad of aspect 1, wherein the coil support pad is modular.

Aspect 12

The coil support pad of aspect 1, wherein the mating feature of the bottom principal surface is a deboss or emboss feature.

Aspect 13

The coil support pad of aspect 1, wherein the support protrusions form a pattern.

Aspect 14

The coil support pad of aspect 13, wherein the pattern of the support protrusions is uniform.

Aspect 15

The coil support pad of aspect 1, wherein the coil support pad is made of Styrofoam and/or expanded polypropylene.

Aspect 16

An outdoor air conditioning unit, comprising
a top cover,
a bottom plate,
a microchannel coil, and
a coil support pad in accordance with aspect 1.

Aspect 17

A method of assembling an outdoor unit, comprising
assembling the coil support pad of aspect 1 on a base pan by mating the mating feature on the coil support pad with a corresponding mating feature on the base pan,
securing an outdoor coil on the coil support pad by securing the outdoor coil to the support feature of the coil support pad,
applying a gasket on a top end of the outdoor coil, and
installing a top cover on the outdoor coil so that a compressive force maintains continuous contact between the outdoor coil and the coil support pad along a length of the outdoor coil.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What is claimed is:

1. A coil support pad for use in an outdoor unit that includes a bottom pan and an outdoor coil, comprising a base including a central portion having a first end and a second end, a first arm portion that extends outwardly in the direction of a first axis from the first end of the central portion to a first terminal end of the first arm portion, a second arm portion that extends outwardly in the direction of a second axis from the second end of the central portion to a second terminal end of the second arm portion, wherein the base is L-shaped and is curved at the central portion as viewed in top view such that the first and second axes form a relative angle $\alpha$, a top principal surface having a vertex and is sloped relative to the vertex, the top principal surface being patterned with a plurality of support protrusions, and the top principal surface having first and second support features that protrude upwardly from the top principal surface such that the first and second support features are disposed a greater distance from the bottom principal surface than the plurality of support protrusions, and a bottom principal surface having a mating feature, wherein the first and second support features are provided on the top principal surface of the first and second terminal ends, respectively, wherein each of the support features has a shape as viewed in top view that follows an outline of a cross-section of a coil header so that the support features are configured to fix a location of each of the respective coil headers, and wherein the base is shaped so that the base as viewed in top view follows the outline of the outdoor coil and wherein the support protrusions on the top principal surface are configured to provide continuous support for the outdoor coil so as to allow a compressive force to maintain continuous contact between the outdoor coil and the coil support pad along a length of the outdoor coil.

2. The coil support pad of claim 1, wherein the first and second axes are on the same plane and perpendicular to one another.

3. The coil support pad of claim 1, wherein the coil support pad is substantially continuous.

4. The coil support pad of claim 1, wherein the one or more support features are configured to localize and/or secure the outdoor coil.

5. The coil support pad of claim 1, wherein the one or more support features is U-shaped as viewed in top view.

6. The coil support pad of claim 1, wherein the mating feature of the bottom principal surface is configured to mate with a corresponding mating feature on a bottom pan.

7. The coil support pad of claim 1, wherein the bottom principal surface further comprises a slotted feature that is configured to allow debris and/or liquid to pass through.

8. The coil support pad of claim 1, wherein the top principal surface is sloped at an angle of between about 2 to about 30 degrees relative to a horizontal axis that passes through the vertex.

9. The coil support pad of claim 1, wherein each of the support protrusions has a cylindrical shape and is substantially circular as viewed in top view.

10. The coil support pad of claim 1, wherein the coil support pad is modular.

11. The coil support pad of claim 1, wherein the mating feature of the bottom principal surface is a deboss or emboss feature.

12. The coil support pad of claim 1, wherein the support protrusions form a pattern.

13. The coil support pad of claim 12, wherein the pattern of the support protrusions is uniform.

14. The coil support pad of claim 1, wherein the coil support pad is made of Styrofoam and/or expanded polypropylene.

15. An outdoor air conditioning unit, comprising a top cover, a bottom plate, a microchannel coil, and a coil support pad in accordance with claim 1, the coil support pad being physically separate from the microchannel coil.

16. A method of assembling an outdoor unit, comprising assembling the coil support pad of claim 1 on a base pan by mating the mating feature on the coil support pad with a corresponding mating feature on the base pan, securing an outdoor coil on the coil support pad by securing the outdoor coil to the support feature of the coil support pad, applying a gasket on a top end of the outdoor coil, and installing a top cover on the outdoor coil so that a compressive force maintains continuous contact between the outdoor coil and the coil support pad along a length of the outdoor coil.

17. The coil support pad of claim 1, wherein the top principal surface is substantially continuous and extends from the first terminal end to the second terminal end across the first arm portion, the central portion and the second arm portion.

18. The coil support pad of claim 1, wherein the shape as viewed in top view of each of the support features is U-shaped.

19. The coil support pad of claim 1, wherein the top principal surface is sloped downward from the vertex such that drainage of liquid is facilitated through the plurality of support protrusions.

* * * * *